United States Patent [19]

Thomas

[11] 4,435,677

[45] Mar. 6, 1984

[54] RMS VOLTAGE CONTROLLER

[75] Inventor: Dale C. Thomas, Ontario, N.Y.

[73] Assignee: Xerox Corporation, Stamford, Conn.

[21] Appl. No.: 325,533

[22] Filed: Nov. 27, 1981

[51] Int. Cl.[3] ..... G05F 1/45

[52] U.S. Cl. ..... 323/235; 219/216; 328/144; 355/14 FU

[58] Field of Search ..... 219/216, 492, 497, 501, 219/509; 307/252 UA; 323/235, 236, 319; 328/144; 355/14 FU

[56] References Cited

U.S. PATENT DOCUMENTS

| | | | |
|---|---|---|---|
| 3,781,516 | 12/1973 | Tsilibes et al. | 219/497 |
| 3,878,358 | 4/1975 | Barton et al. | 323/236 |
| 4,340,807 | 7/1982 | Raskin et al. | 219/501 |
| 4,360,783 | 11/1982 | Nagasawa et al. | 328/144 |
| 4,377,739 | 3/1983 | Eckert et al. | 323/235 |

OTHER PUBLICATIONS

Van Cleave et al., "Complete Half-Wave Thyrister Control", IBM Tech. Discl. Bull., vol. 16, No. 9, Feb. 1974, p. 2962.

*Primary Examiner*—A. D. Pellinen

*Attorney, Agent, or Firm*—Robert A. Chittum; John B. Mason

[57] ABSTRACT

A power regulating device which maintains a constant rms voltage across a load by periodically interrupting the application of voltage to the load for a predetermined number of cycles. To accomplish this, a functional solution to the equation which describes the relationship between the rms line voltage developed across the load and the rms voltage of a desired control set point is continuously provided. The solution of this equation is obtained by squaring a sampling of the applied load voltage, subtracting the square of the desired control voltage, and then integrating over time the difference therebetween. When the resultant time integral reaches a predetermined constant value, the voltage applied to the load is interrupted for a predetermined number of half or full cycles.

8 Claims, 10 Drawing Figures

RMS VOLTAGE CONTROLLER

BACKGROUND OF THE INVENTION

The present invention relates generally to the power regulating and electrostatographic printing arts. More particularly, the invention concerns a rms voltage controller for ensuring constant power dissipation by a fixed load regardless of variations in the line input voltage. In a preferred form, a controller in accordance with the invention is advantageously employed to control the rms voltage supplied to a fusing apparatus of an electrostatographic printing machine.

In the process of xerography, an exemplary form of electrostatographic printing, heat is applied to permanently affix powder toner images to a variety of support surfaces, such as individual copy sheets. This process of applying heat is conventionally referred to as fusing and is carried out by a fusing apparatus, or simply a fuser. A resistance element, such as a lamp, is typically employed to generate the heat necessary for the fusing process.

To maintain a consistent level of copy quality, it is necessary to maintain the temperature of the fuser within a critical tolerance range. If the fuser temperature is too low, fusing of the powder images may be incomplete, producing smeared or incompletely copied final images. Fuser temperatures which are too high raise the likelihood that the copy sheets may scorch or burn. The sources to which printing machines are connected, typically 115 volts AC, exhibit inevitable variations in the line voltage supplied. In recognition of these voltage fluctuations, a variety of regulating devices have been heretofore developed.

For instance, it is known in the prior art to control the power input to the fuser in response to voltage levels across the fuser heat source. U.S. Pat. No. 3,881,085 to Traister, discloses a fuser control circuit in which a switching means, such as a silicon controlled rectifier is triggered to interrupt power to the fuser heating source when a preset level of line voltage is detected across the heating element. Separate R/C circuitry is used to set and reset an amplifier to selectively inhibit the silicon controlled rectifier and thus interrupt power supply to the heating element.

Another prior art control system is shown in U.S. Pat. No. 3,735,092 to Traister. A thermistor senses changes in the fuser temperature, providing a signal which controls a switching amplifier. When a normal operating temperature is attained in the fuser, the switching amplifier is triggered to a non-conducting state which opens a switch to interrupt power to the fuser heating element.

Another known class of regulating device seeks to maintain a constant power input to the fuser. In U.S. Pat. No. 3,961,236 to Rodek et al, for example, constant power regulation is sought by monitoring both the voltage across the fuser load and the current therethrough. A summation of the detected load voltage and current provides an approximation of the power consumption which is utilized to control the power input to the fuser. To effect the desired control, a triac is selectively gated, i.e. triggered on and off, to inhibit the supply of power from the source to the fuser circuitry, the triggering being effected at zero crossing points of the supply voltage waveform for predetermined numbers of half cycles.

Another illustrative circuit for regulating the power applied to a load by controlling the number of cycles of supplied voltage is shown in U.S. Pat. No. 3,579,096 to Buchanan. U.S. Pat. No. 4,223,207 to Chow discloses a circuit for controlling the power supplied to a load by varying the duty cycle of the AC signal supplied to the load.

Other known control systems have been developed to regulate rms voltage across a fuser element. Since it may generally be assumed that the resistance of the fuser element will not change appreciably, it follows that control of the rms voltage across the load will effectively control the power dissipated thereby. In one such controller, a digital signal equivalent of a sample of the fuser input voltage is supplied to a processor. In response to the digitized signal, the processor selectively gates the input voltage source across the fuser heating element in accordance with a plurality of gate activation rates stored in a register associated with the processor.

The foregoing controllers are either costly or do not optimally deliver accurate, precise, control of power supplied to the load. A characteristic problem with the controllers which function to periodically inhibit or suppress full or half cycles of the applied waveform is the inability of the control circuitry to accurately determine when a sufficient number of cycles have been conducted to warrant interruption of the delivery of voltage to the load. The present invention is primarily directed to alleviation of this problem.

SUMMARY OF THE INVENTION

In accordance with the invention, there is provided a control system for delivering a constant level of power to a fixed load despite variations in the line voltage. In general, this is effected by a control circuit which employs closed loop feedback control to apply a constant rms voltage across the load.

This is accomplished by a circuit and method which functionally provides a continuous solution to the equation which describes the relationship between the rms line voltage developed across the load and the rms voltage of a desired control set point. Briefly, the solution of this equation is obtained by monitoring, i.e. sampling, the voltage across the load, squaring the sample voltage via a linear piecewise approximation circuit, subtracting the square of the desired control voltage, and then integrating the difference over time. When the resultant time integral reaches a fixed value, the primary current flow to the load is interrupted for a predetermined number of half or full cycles.

The control circuit of this invention is particularly advantageous in controlling the rms voltage across a radiant fuser lamp in an electrostatographic printing machine. In such an application, the circuitry preferably includes a microprocessor which controls a triac to selectively gate the input line voltage across the fuser heating element. In this preferred form, a fully rectified sample of the fuser load voltage is converted into a signal representing the square thereof. An integrator then continuously sums the difference between this square of the sampled load voltage and the square of a predetermined control voltage. When this continuous summation equals a fixed reference, predetermined in accordance with the system equation, a signal indicative thereof is supplied to the microprocessor which, in turn, gates off the triac for a predetermined number of full or half cycles, interrupting the voltage applied to the load.

DESCRIPTION OF THE PREFERRED EMBODIMENT

Figure 2:
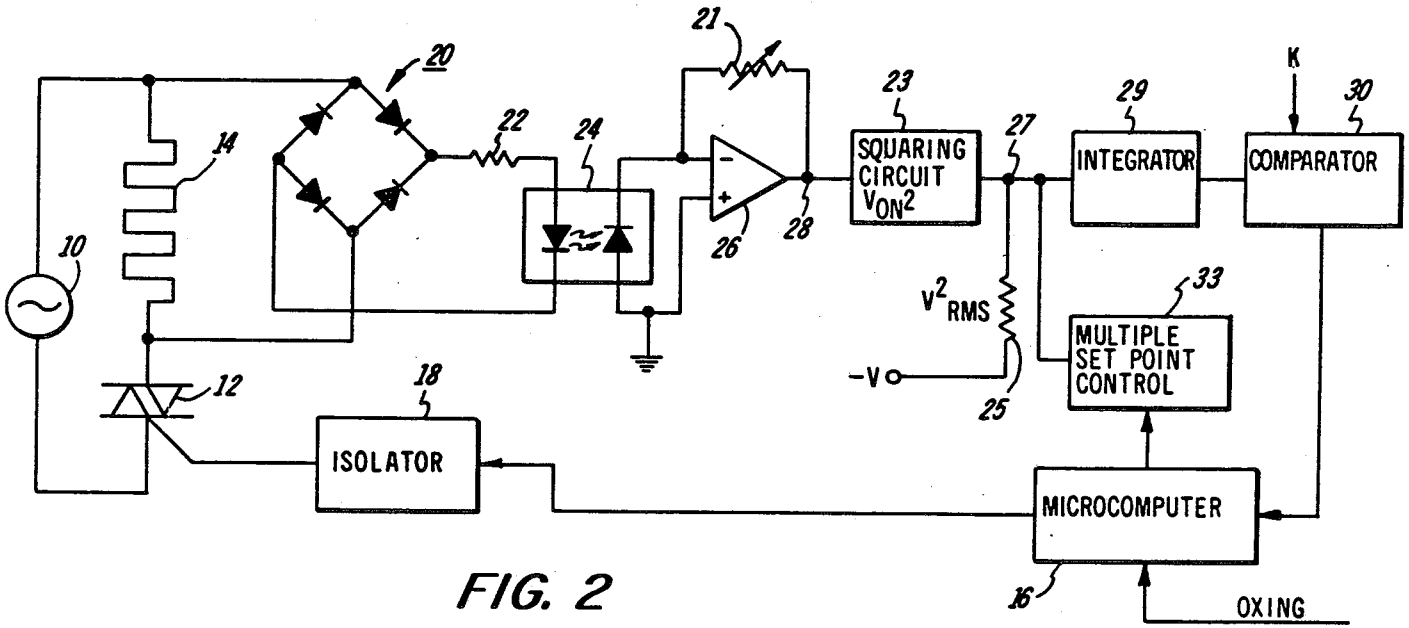
FIG. 2 is a generalized schematic diagram of a voltage controller circuit according to the present invention.

FIG. 2 schematically illustrates a rms voltage controller according to this invention. An AC line voltage is applied from source 10 through a switching device 12, such as a triac, to a fuser element 14 which is connected in series therewith. As will be described in more detail below, a control signal generated by a microcomputer 16 is applied through isolator 18 to the gate electrode of the triac 12 to control the triggering of the triac and, consequently, the supply of AC voltage to the fuser element 14. Use of a process or microcomputer in a fuser control circuit is well known in the art as exemplified by U.S. Pat. No. 4,340,807 to Raskin et al. The control or gating signal is developed as a function of the AC line voltage applied across fuser element 14 and a predetermined reference set point voltage. The adapted convention is such that voltage is applied from source 10 to the element 14 when the triac 12 is gated on. Conversely, with the triac gated off, the application of voltage to the element 14 is interrupted. As will be developed more fully hereinafter, in the preferred mode of operation, a constant level of voltage across fuser element 14 is provided by selectively gating triac 12 so as to "drop" or interrupt half or full cycles of the applied voltages or multiples thereof.

To effect this operation, a sample of the AC voltage applied across element 14 is taken by bridge 20. The diagonals of bridge 20 are connected so that full wave rectification of the sampled waveform is obtained. It will be appreciated that the sensor bridge 20 presents a very high impedance relative to the impedance of the fuser element 14. Consequently, virtually all of the current flow is through element 14 and the attendant voltage drop is substantially all of that applied from source 10.

This full wave rectified waveform is provided by bridge 20 converted through resistor 22 and optocoupler 24 into a proportional current. It will be appreciated by those skilled in the art that optocoupler 24 provides isolation between the "mains" or AC supply line, and the DC realm of the low voltage control circuitry. The performance of optocoupler 24 is substantially linear so that the current output thereof is proportional to the sample of the fuser load voltage. This current signal is fed to the inverting input terminal of operational amplifier 26. With the positive input terminal tied to ground, amplifier 26 is connected in an inverting op-amp configuration, functioning as a current to voltage converter. The variable resistor 21 connected between node 28 on the output of op-amp 26 and the negative input terminal of the op-amp is utilized to provide adjustment between the voltage level of op-amp 26 and the following circuitry, as will become apparent hereinbelow. It will be noted at this juncture that the output of op-amp 26 at node 28 is an in-phase, full wave rectified, proportional replica of the voltage waveform applied across fuser element 14.

The output of op-amp 26 is fed to squaring circuit 23 which provides a signal representing the square of the sampled load voltage. Squaring circuit 23 is a linear piecewise approximation circuit which will be described more fully hereinafter with reference to FIG. 3.

To provide a reference indicative of the desired control voltage, resistor 25 is connected between a negative supply voltage and the node 27 on the output of squaring circuit 23. The values for the negative supply voltage and resistor 25 are selected to provide a set point signal representing the square of the desired control voltage level. It will be appreciated that the control voltage level will be selected in accordance with the requirements of the particular fusing device into which the circuitry here described is incorporated. Resistor 21 which is associated with op-amp 26 is provided for adjusting, or balancing, the voltage level input to the squaring circuit 23 and the combination of resistor 25 and its supply so that the desired set point level is provided. By virtue of the common connection of node 27, there is generated a signal which represents the difference between the square of the sampled voltage and the square of the selected control voltage. This difference signal is summed over time by integrator 29 and provided to a comparator 30, wherein a comparison is made against a predetermined, fixed reference K. Comparator 30, when triggered, provides a signal to microcomputer 16 indicating that an appropriate number of cycles of the applied voltage have been conducted to provide the desired rms voltage level across element 14. The microcomputer thereupon gates off triac 12 to drop a predetermined number of cycles or half cycles. For well known safeguards against RFI emissions, the interruption of the source voltage is preferable accomplished at zero crossing points of the waveform. To this end, a zero crossing signal, labeled OXING in FIG. 2, is generated using conventional techniques and supplied as an input to microcomputer 16.

Figure 1:
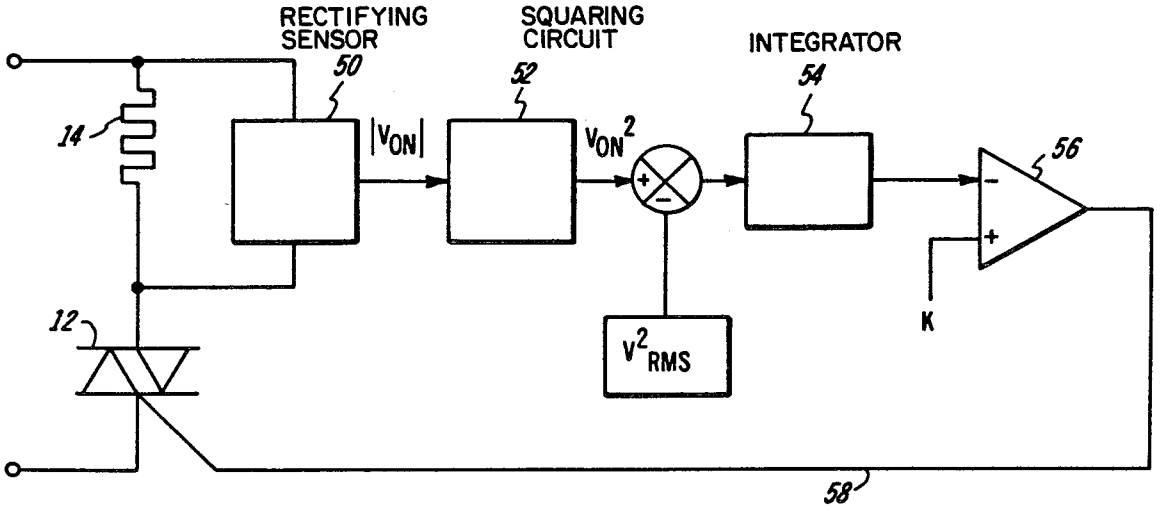
FIG. 1 is a simplified schematic diagram illustrating the functional operation of a voltage controller according to the present invention.
Figure 7:
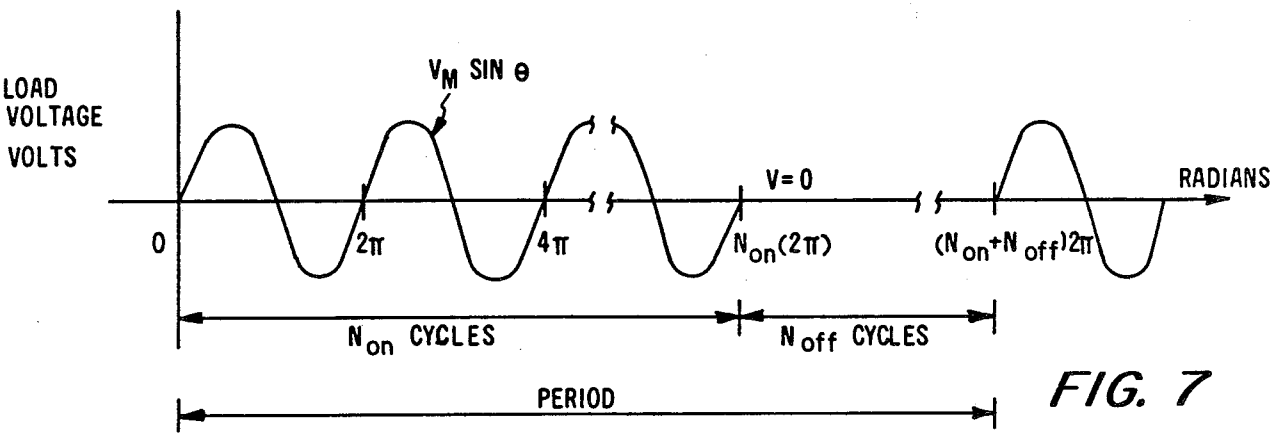
FIG. 7 is a waveform diagram useful in understanding the invention.
Figure 8:
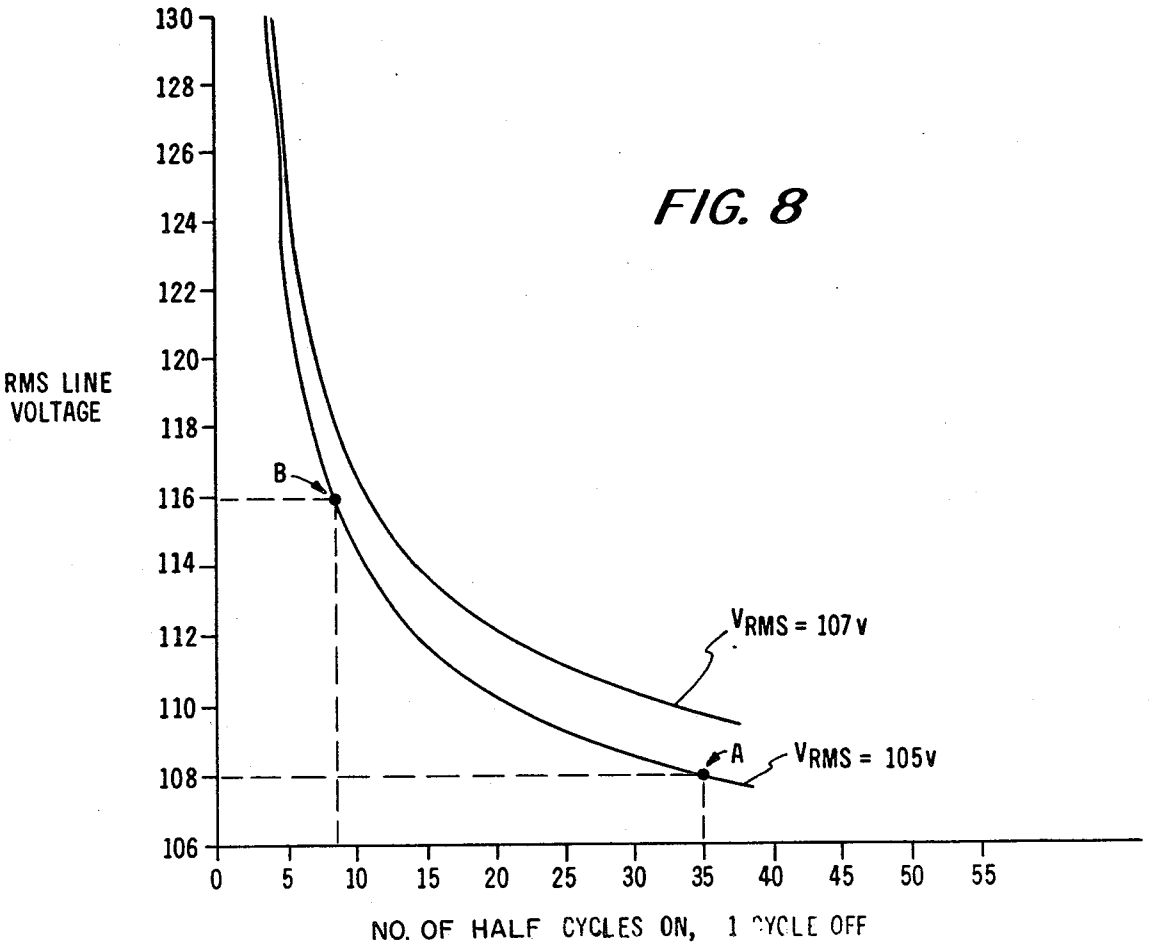
FIG. 8 is a graphical plot illustrating solutions of the control equation of the present invention for two exemplary set point voltages.

The functional operation of the circuit to control the rms voltage across a load is best understood with reference to FIGS. 1, 7, and 8. Considering a periodic voltage waveform consisting of repetitive on and off cycles as shown in FIG. 7, the rms value for the total period is related to the number of on and off cycles by the following equation:

$$V_{rms} = \left(\frac{N_{on}}{N_{on} + N_{off}}\right)^{\frac{1}{2}} V_{on}$$

where $V_{rms}$ = desired control voltage (rms)

$V_{on}$=the load voltage during the on cycles
$N_{on}$=number of on cycles
$N_{off}$=number of off cycles
and $N_{on}+N_{off}$=period This equation is derived from the definition of an rms voltage for a waveform as illustrated in FIG. 7. In that figure, and in the foregoing derived equation, it is assumed that $V_{on}$ remains essentially constant over the relatively small number of cycles in each period. For proper operation of the controller, however, it is not essential that $V_{on}$ remain constant as can be mathematically demonstrated from the general form of the rms equation.

In rms controllers of the type which periodically drop cycles, there is difficulty in accurately establishing when a sufficient number of cycles have been conducted so that the load should be turned off. This problem is graphically illustrated in FIG. 8 which shows two curves plotted from the equation above when $N_{off}$ equals full one cycle and $N_{on}$ equals an integer number of conducted half cycles for $V_{rms}$, i.e. set point control voltages, of 105 and 107 volts. As can be seen, when the line voltage is relatively close to the desired set point level, e.g. 108 volts at point A on the plot for 105 volt set point, a relatively large number of half cycles are conducted before the controller interrupts the flow for one complete off cycle. At point A, for example, to maintain a 105 volt set point level with a sampled line voltage of 108 volts, 35 half cycles would be conducted before dropping one cycle. In contrast, at point B on the same curve, to maintain the same 105 volt control level with an input line voltage of 116 volts would necessitate a cyclical pattern of 9 conducted half cycles followed by one non-conducted full cycle. At even higher line voltages, both curves exhibit extremely steep slopes and non-linearity. It is in this area of operation that it is extremely difficult for known rms controllers to accurately maintain the desired degree of control.

The controller of the present invention overcomes this problem by actually solving the above equation in a modified form. Starting with the above relationship, the equation can be manipulated to give:

$$(V^2_{rms})N_{off}=N_{on}(V^2_{on}-V^2_{rms})$$

Since $V_{rms}$ is a known value (the control set point) and since $N_{off}$ is fixed for any given system, i.e. is preselected, the quantity on the left side of this equation is a constant:

$$(V^2_{rms})N_{off}=K$$

Substituting this constant K yields:

$$K=N_{on}(V^2_{on}-V^2_{rms})$$

As applied to the controller, this equation is interpreted to mean that if the square of the sampled load voltage ($V^2_{on}$) minus the desired control voltage squared ($V^2_{rms}$) is continuously summed until it equals a predetermined fixed reference, the number of conducted cycles it would take to reach that reference would be $N_{on}$ cycles. As the load voltage ($V_{on}$) varies with line voltage fluctuations, the number of conductive cycles would also vary to satisfy the equation and thus follow the curves of FIG. 8.

The value of the fixed reference (K) is determined by the relationship noted above, i.e. $K=(V_{rms})^2N_{off}$. Selecting the number of $N_{off}$ cycles (for example, 1) and selecting the rms control voltage desired for the load determines the required value of K. Implementation of the control equation then becomes a matter of scaling down both sides of the equation to allow operation with lower voltage electronic components, for example, op-amps.

FIG. 1 schematically illustrates the functional implementation of this control equation. It will be seen that this simplified block schematic corresponds to the previously described circuit of FIG. 2. Thus, the sample of the voltage applied across element 14 during a conduction cycle is fully rectified by sensor 50 to provide the sample $V_{on}$. This sample voltage is then squared by squaring circuit 52 to provide $V^2_{on}$, which is combined with the square of the desired control set point ($V^2_{rms}$) to provide a difference signal. The time integral of this difference signal is provided by integrator 54 as the negative input to comparator 56. The other input of the comparator is a predetermined reference K determined in accordance with the relationships above. When the comparator signifies that the continuously summed difference between $V^2_{on}$ and $V^2_{rms}$ is equal to the fixed reference K, gating off of the triac 12 is effected by the control loop 58 illustrated in FIG. 1.

Figure 3:
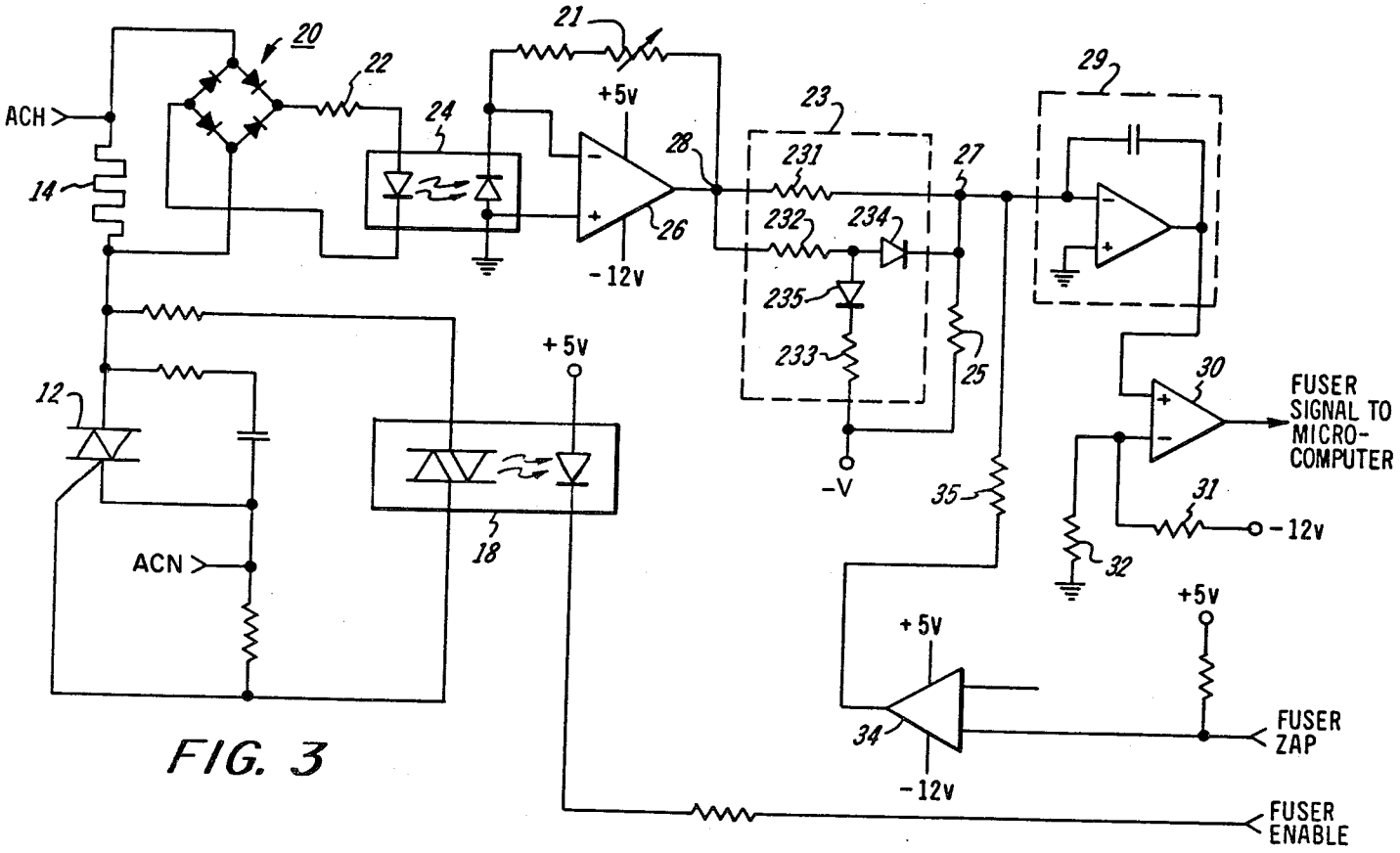
FIG. 3 is a detailed electrical schematic of the controller circuit of FIG. 2.

The preferred implementation of the foregoing is illustrated in FIG. 3 wherein the same reference numerals of FIG. 2 have been employed to describe the same or consistent elements. The connection to line voltage is denoted in FIG. 3 by the references ACH for the AC hot interconnection and ACN for the AC neutral interconnection. This provides a current flow through fuser element 14 down through triac 12 when this element is gated into a conductive state. When triac 12 is non-conducting, it can be seen that no current flows through fuser element 14. During the conductive mode, a sample of the voltage is taken by bridge 20 and converted to a current, and back to a voltage by the operation of optocoupler 24 and op-amp 26 as described above with reference to FIG. 2. The photo-voltaic operation of these elements produces an output of the op-amp at node 28 which is a virtual image of the sampled full wave rectified AC waveform which has been multiplied by a gain factor of op amp 26 which is adjusted by the variable resistor or pot 21. This output voltage represents $V_{on}$ in the controller theory described above. This sample is then squared by squaring circuit 23 to provide the signal representing $V^2_{on}$. The elements comprising squaring circuit 23, i.e. resistors 231, 232, and 233 and diodes 234 and 235 provide a piecewise approximation, or buildup of a voltage squared curve. This approximation technique will be apparent to those skilled in the art as an addition of a series of straight lines, the straight lines being provided by setting different levels of cut-in for the segments of resistors and diodes. As many cut-in circuits as required may be used, as is necessary to approximate the desired square curve for a given application. The greater the number of segments, the greater will be the accuracy of the squared output. The segments illustrated in FIG. 3 have been found adequate for the present embodiment. As in FIG. 2, a signal representing the square of the desired control voltage $V^2_{rms}$ is subtracted from the output of the squaring circuit 23 at node 27. It will be appreciated that, although the subtraction process represents a subtraction of signals representing the respective squares of the sampled voltage and the set point voltage, the actual process is accomplished in terms of current. The difference signal produced by this operation is fed to a conventional op-amp integrator. The output of the integrator is then compared by comparator 30 against a predetermined reference K which is established by the network consisting of resistors 31 and 32 and the negative supply voltage on the inverting terminal of the comparator.

The interactive operation of integrator 29 and comparator 30 can be understood as follows. Since the underlying theory dictates that the correct number of conducted on cycles is given when the difference between the square of the sampled voltage and the square of the desired control voltage equals a predetermined reference, the integrator can be viewed as a summer which continuously compiles, or keeps track of, the difference between these two quantities. This continuously tracked difference is compared against the fixed constants placed on the negative terminal of comparator 30. For a typical fuser application, the mode of operation will prescribe that the line voltage is higher than the desired set point, for example a line voltage of 115 volts versus a set point of 105 volts. In such a mode, the integrator will integrate, or sum, downward because of the input on its negative terminal. This downward integration will continue for each conducted cycle until the threshold set by the fixed value K on the comparator is reached. When such a condition is attained, the comparator triggers providing an output signal which signifies that a sufficient number of cycles has been conducted to yield the desired constant rms voltage and, accordingly, that it is now time to interrupt application of the voltage to the element 14. In the preferred embodiment of the invention, this comparator signal is employed as a fuser signal input to a microcomputer which may either be dedicated to fuser control or a multi-tasking system microcomputer. As shown in FIG. 2, the microcomputer will also have an input signal indicating that the line input is at a zero crossing point. This zero crossing input is utilized as a clock which prescribes the time to turn on or turn off the triac, i.e. at zero crossing. This, of course, is preferred for purposes of noise minimization. The control signal from the microcomputer is shown as the input labled FUSER ENABLE in FIG. 3 and is shown as input to isolator 18 in FIG. 2. The isolation function is performed by isolator 18, which is illustrated as being an opto-triac.

Figure 9A:
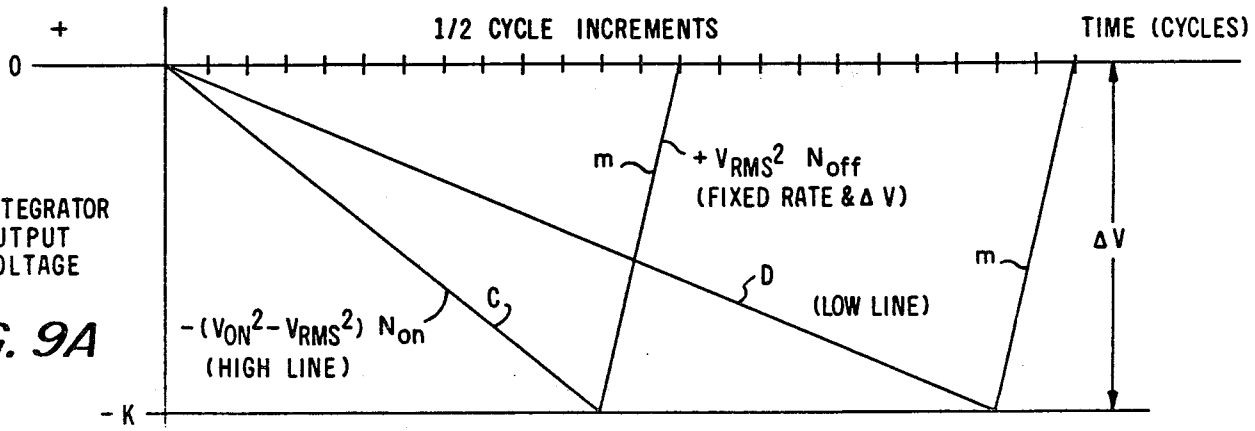
FIGS. 9A and 9B are waveform diagrams useful in understanding the invention.
Figure 9B:
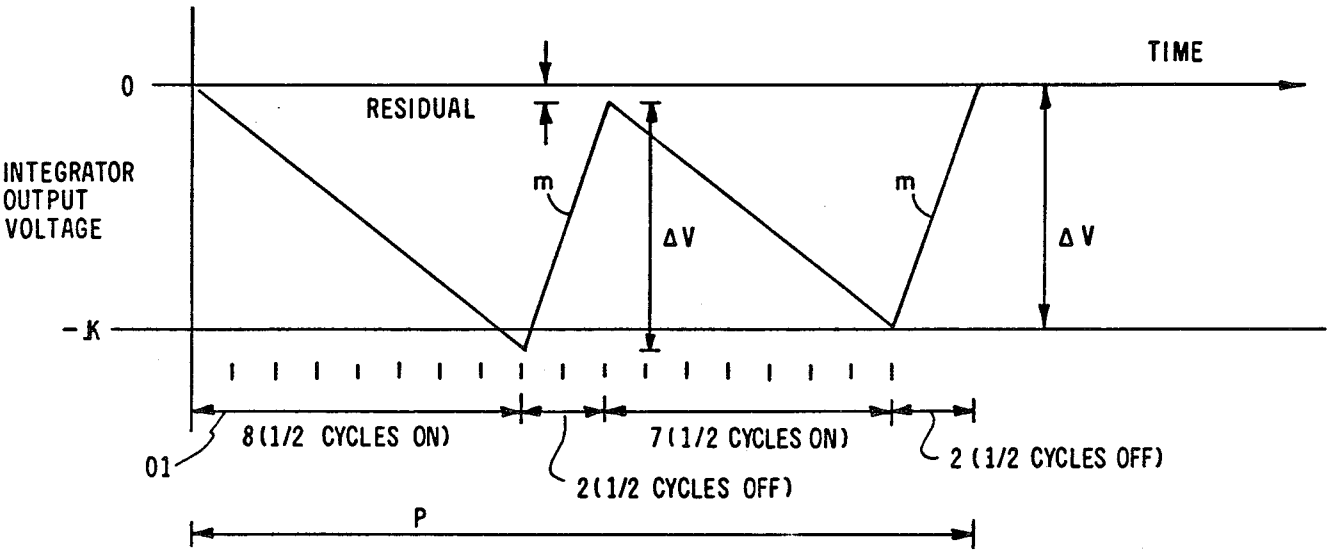

The implementation of the control equation by the cooperative action of integrator 29 and comparator 30 advantageously functions in a self correcting mode, as can be best understood with reference to FIGS. 9A and 9B. In both of these figures the vertical axis corresponds to the integrator output voltage while the horizontal axis represents time in half cycle increments. In FIG. 9A, two separate curves, C and D, illustrate operation of the controller under high (curve C) and low (curve D) line voltage conditions. Since integrator 29 has a gain = −1, the actual circuit implementation of the control equation detailed above is as follows:

$$-(V^2_{on}-V^2_{rms})N_{on}+(V^2_{rms}N_{off})=0.$$

The first term of this re-arranged control equation describes the downward integration which occurs during the conducted on cycles. This downward integration continues until the fixed threshold (−K) is reached. As described above, at this point, the controller triggers into the off, or non-conductive state. As described by the second term in the last mentioned equation, during this off stage, the integrator output voltage increases positively towards zero. Since the controlling relationship for this portion of the operation is fixed ($V^2_{rms}N_{off}$=a constant) the integration towards zero is likewise fixed with respect to both rate and magnitude. That is to say, the slope (m in FIG. 9A) of the curves corresponding to the positive integration and the change in voltage (delta V in FIG. 9A) are the same regardless of the level of the line voltage which is being corrected. Thus, whether in a high (curve C) or low (curve D) line voltage condition, once the fixed reference is attained, there is an identical correction towards zero.

For illustrative purposes, the traces of FIG. 9A have been idealized to show exact control between zero and the fixed reference (−K). Since, in a preferred embodiment, the number of on and off cycles, i.e. $N_{on}$ and $N_{off}$, are integral numbers of full half cycles, the actual operation of the circuit is more correctly described by the examplary wave form of FIG. 9B. As shown by way of example, during the initial on cycle 01, the fixed reference (−K) is reached at a point during the conduction of the last (8th) conducted full half cycle. Since triggering is accomplished at zero crossing points of these full half cycles, the load cannot be disabled precisely at the threshold but, instead, must await completion of the last half cycle. In FIG. 9B this is shown to be a slight "overshoot" beyond the (−K) level. Since, as explained above with reference to FIG. 9A, the positive going response of the integrator is fixed with respect to rate and magnitude, this "overshoot" results in a return to a level which is somewhat below the zero point. Accordingly, after this single 8 cycle on, 2 cycle off sequence, the desired level of rms voltage across the load has not been achieved. Instead, a residual, or incremental, voltage error remains as shown in FIG. 9B. This error is corrected, however, during the next on-off cycle of the controller since, when triggered back into conduction, the integrator begins integrating downwardly from the residual, or error, level towards the fixed reference level (−K). It will be appreciated that this corrective operation of the circuit will occur over a number of sequences of on and off cycles in a manner analogous to a long time constant. That is to say, there will be continuous compensation for the overshoot or residuals in a manner tending always to provide the desired constant rms voltage across the load.

To provide additional flexibility, the circuit illustrated in FIGS. 2 and 3 also include provisions for operating the fuser element at more than one reference level, i.e. at two or more different control set points. This multiple set point control 33 of FIG. 2 is realized in FIG. 3 by the combined operation of op-amp 34 and resistor 35. When enabled by the FUSER ZAP input from the microcomputer, this network operates in parallel with resistor 25 and its supply voltage to change the negative current flow at node 27. This results in a boost of the set point level so that the fuser will operate under higher rms voltage, and hence power, conditions. This is convenient to provide fast warmup of the fuser element in a machine designed to operate with no standby power. It will be appreciated that any number of programmable resistors, i.e. digitally controlled multiple set points, could be employed to provide a range of operating rms levels.

Figure 4:
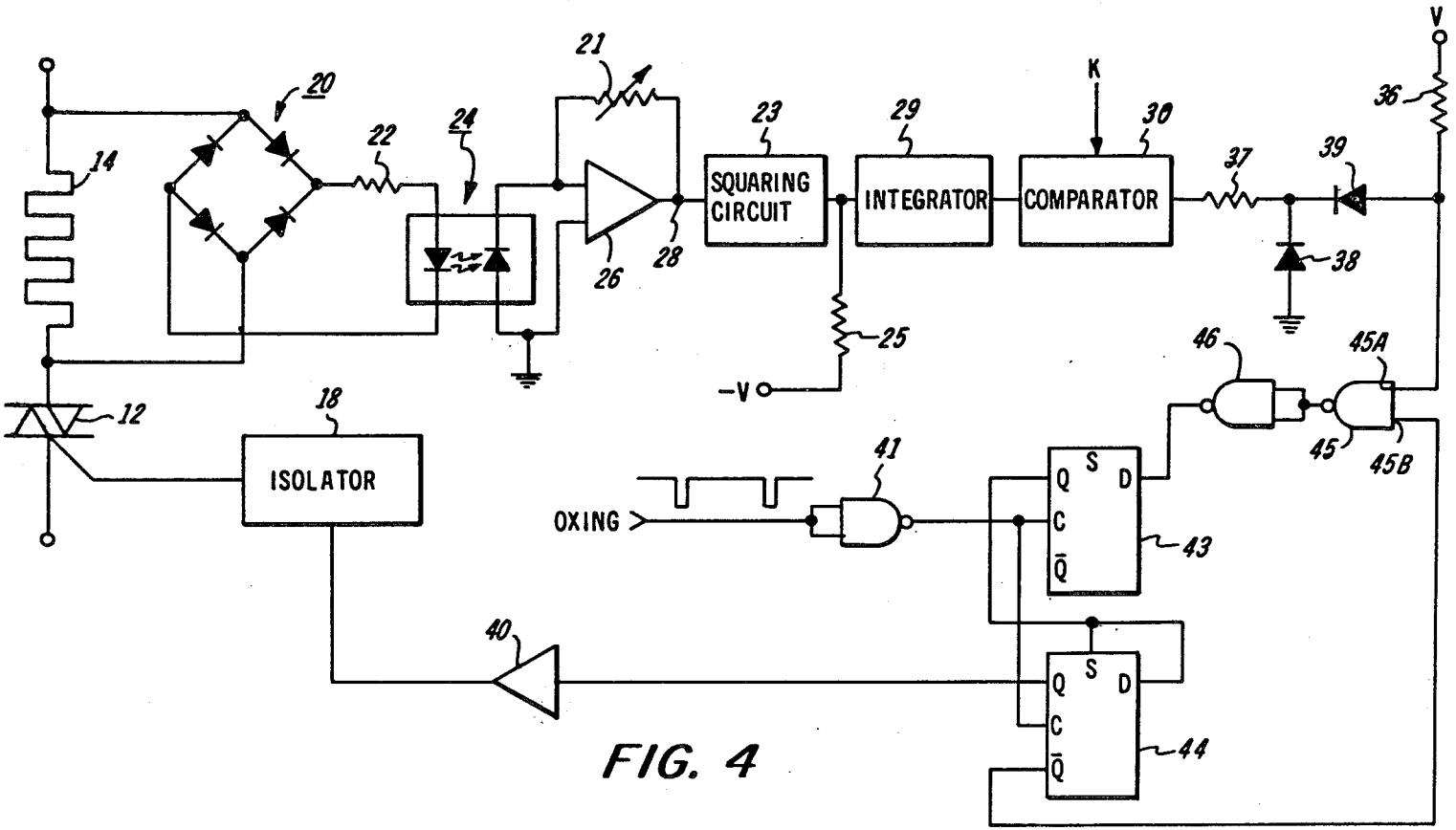
FIG. 4 is a schematic diagram illustrating a digital logic embodiment of the triac control loop.

An alternate embodiment of the control circuit of the present invention is illustrated in FIG. 4. As reflected in the employment of the same reference characters as utilized in FIG. 2, the circuitry between bridge 20 and comparator 30, inclusive, function as described hereinabove with respect to the preferred embodiment. The controller of FIG. 4 differs in the use of a digital logic full cycle control loop rather than the microcomputer embodiment of FIGS. 2 and 3. The network comprising resistors 36 and 37 and diodes 38 and 39 and the supply voltage connection provide a voltage level translation of the output of comparator 30 for compatibility with the ensuing logic elements of the control loop. This control loop functions in a similar manner to the microprocessor control loop, selectively gating triac 12 off when the comparator output signal signifies that the correct number of on cycles have been conducted. The gating signal is supplied by buffer 40 through isolator 18 to triac 12. Buffer 40 generates this signal when enabled by a command from D flip flop 44. Such a gate command signal is generated whenever a zero crossing pulse (designated OXING) clocks the Q output of flip flop 44 high. The Q output of D flip flop 44 represents an indication that comparator 30 has signified that a sufficient number of on cycles have been conducted and, consequently, the triac should be turned off. Thus when comparator 30 switches high, the Q output of D flip flop 44 is set high concurrent with the OXING clock, and the triac will be disabled.

As noted above, this circuit is designed to provide a full cycle, i.e. two half cycles, turn off. To accomplish this another D flip flop 43 is provided. The clock input of D flip flop 43 is fed by the output of NAND gate 41. As can be seen, since both inputs of NAND gate 41 are tied together, this gate functions as an inverter responding to the inputted zero crossing, OXING, signal providing a clock pulse to both flip flops 43 and 44.

The operation of this control may be illustrated as follows. Normally, i.e., when triac 12 is conducting and voltage is being applied across the element 14, there is no control output signal from comparator 30. Accordingly, there is a zero on input 45A of NAND gate 45 and, consequently, a one on the output of this gate. This produces a zero on the output of NAND gate 46 which places a zero on the D input of flip flop 43. On a clock cycle the Q output of flip flop 43 goes low placing a zero on both the D and S inputs of flip flop 44. Thus a zero is clocked out of the Q output of flip flop 44 in subsequent clock cycles and placed on the input of buffer 40. This results in a zero on the output of buffer 40 and, consequently the triac remains conductive.

When a signal is generated by the comparator indicating that the triac should be turned off, a one is placed on input 45A of NAND gate 45. This produces a zero on the output of this NAND gate and a one on the output of NAND gate 46 which sets the Q of flip flop 43 to one on the next clock pulse, i.e. coincident with the zero crossing of the waveform. This results in the setting of Q output of flip flop 44 to a one. This one on the input of buffer 40 causes a one on the output which drives isolator 18 so as to turn off the triac. The zero which is simultaneously provided on the $\overline{Q}$ output of flip flop 44 is fed back to input 45B of NAND gate 45. This results in a one on the output of NAND gate 45 and a zero on the output of gate 46 and the D input of flip flop 43. On the next clock (i.e. the end of the first half cycle off) a zero is clocked to flip flop 43 yielding a zero on the Q output thereof. This zero is applied to the S and D inputs of flip flop 44 and on the next clock (i.e., the end of the second half cycle off) the Q output of flip flop 44 is reset to a zero effecting a gating on of triac 12.

Figure 5:
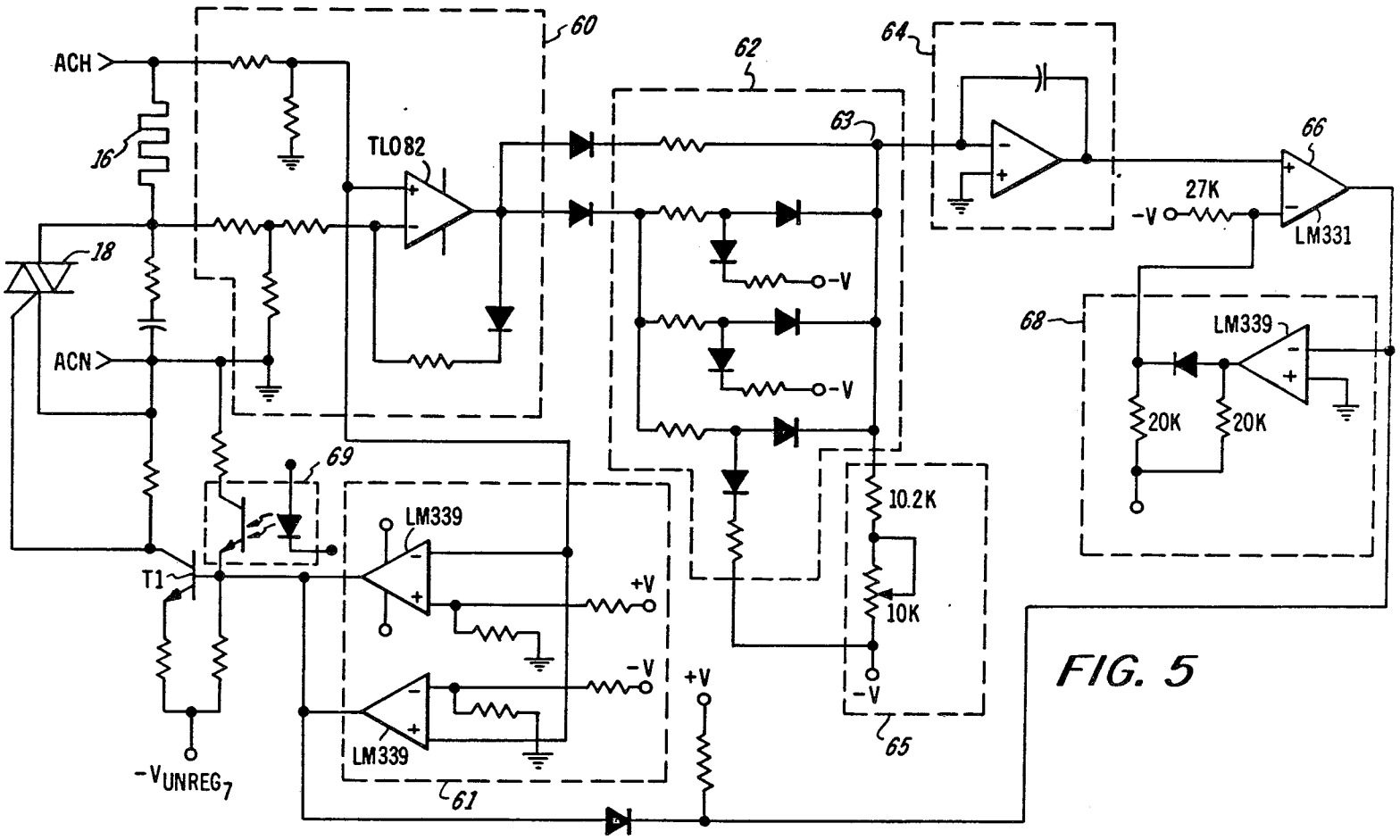
FIG. 5 is a detailed electrical schematic diagram illustrating an analog embodiment of the triac control loop.

An analog technique for full cycle turnoff is illustrated in FIG. 5. In this figure the connection of a load 16 to an alternating source via AC hot and neutral terminals ACH and ACN, respectively is controlled by a triac 18. In this configuration the entire control circuit is connected to the mains side of isolator 69. A sample of the applied voltage is taken by a differential voltage sensor enclosed within the phantom lined box labeled 60. In contrast to the sensing of a fully rectified wave as in FIG. 1, differential voltage sensor 60 senses only the positive half cycle of the applied waveform. This sample is then squared by the squaring circuit 62. This circuit is a more accurate approximator of the squaring function since more piecewise approximation segments are included herein than in the squaring circuit of FIG. 2. The squared signal produced by this circuit is pumped, in current form, into node 63 and the inverting input terminal of the op-amp of integrator 64. To provide the difference signal for integration, i.e. $V^2_{on}-V^2_{rms}$, a negative current for node 63 is provided by the set point control 65. Adjustment of the proper set point is accomplished by means of the variable 10K resistor included in the control 65. The integrated difference signal is compared in comparator 66 against the predetermined reference K as provided by the voltage drop across the 27K resistor tied to the negative input of comparator 66. The analog control network 68 functions in response to a triggered output of comparator 66, to permit disablement of the triac for one full cycle. Disablement occurs by removing the zero crossing trigger pulses which are normally provided by the conventional zero crossing detector 61 to the base of the Darlington transistor T1.

Figure 6:
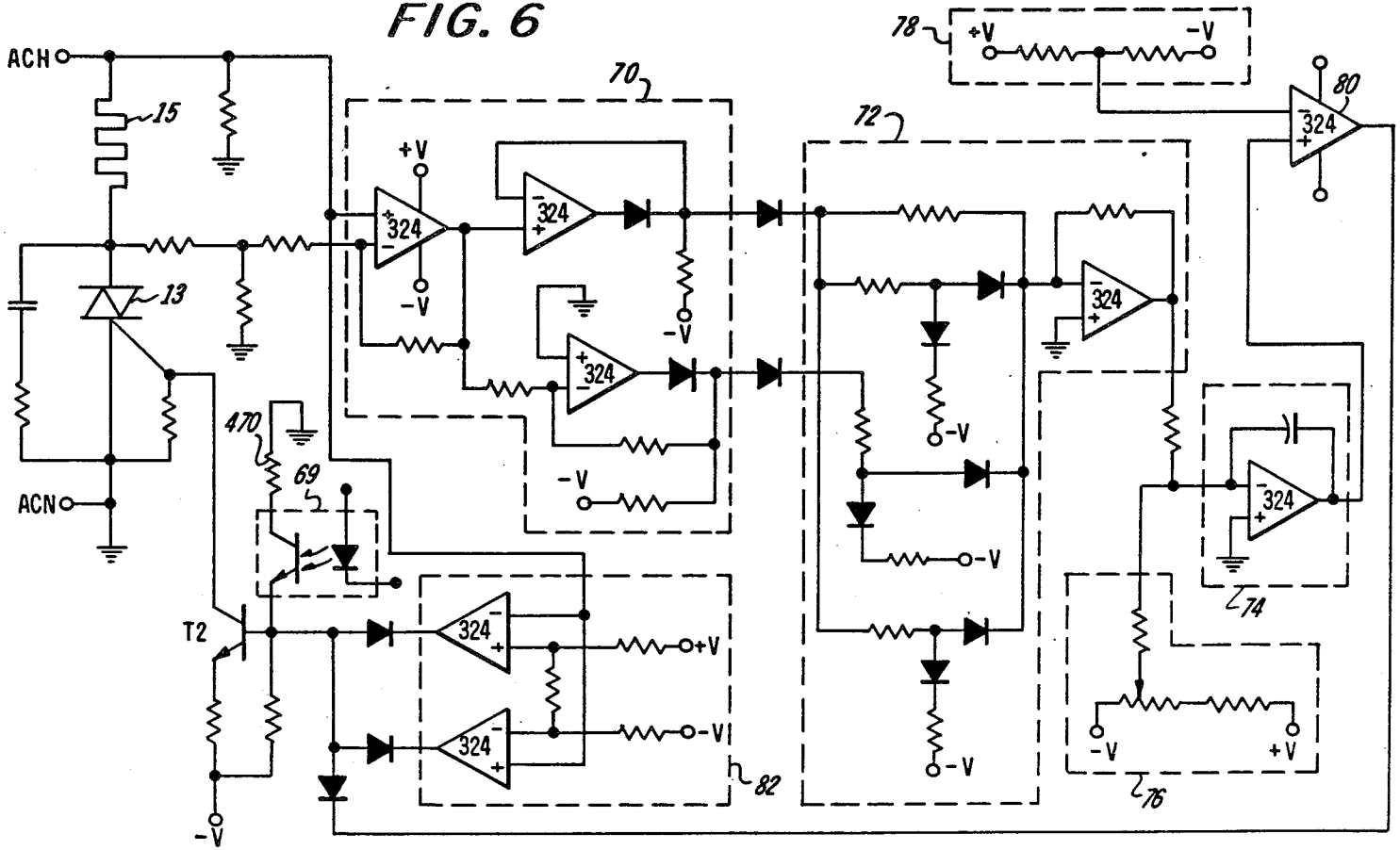
FIG. 6 is a detailed electrical schematic illustrating another analog embodiment of the triac control loop.

Yet another embodiment of a controller according to the invention is illustrated in FIG. 6. The embodiment is a half cycle off controller which, like the previous embodiments, functions to solve the rms control equation. In this instance, both the positive and negative portions of the voltage waveform applied across the load element 15 is sampled by a differential voltage sensor 70, by virtue of the provision of dual op-amps. This embodiment also functions to solve the controller equation discussed above providing a square of the sampled voltage at the output of squaring circuit 72 which is combined with the set point signal generated by the set point control 76 to provide a difference signal which is integrated by integrator 74. This integrated difference signal is compared against a fixed reference provided by the network 78 and compared in comparator 80. The output of comparator 80, in similar fashion to the embodiment of FIG. 4, works in conjunction with the zero crossing signal provided by the zero crossing detector 82 to sink the base of the Darlington transistor T2 and open the gate of the triac. This removal of the gating pulses is provided on a half cycle basis when it is necessary to reduce the rms voltage applied to the load 15.

The power regulating concepts described herein and discussed in relation to a particular embodiment in a fuser controller, are not limited in scope to such an embodiment or to triac controlled AC loads. Rather the appended claims are intended to embrace modificationss in the details of the embodiments described herein and the control, per se, of rms voltage through any resistive load.

I claim:

1. A circuit for monitoring and controlling voltage across a load, the voltage being applied from an alternating source and having a zero crossing point for each half cycle of its alternating waveform, said circuit comprising:

(a) means for sampling the voltage across the load;

(b) means coupled to said sampling means for providing a load square signal representing the square of the sampled load voltage;

(c) means for providing a set point signal representing the square of a desired control voltage;

(d) means for continuously combining said load square signal and said set point signal to provide a third signal representing the difference therebetween;

(e) means for continuously integrating said third signal to produce an integrated third signal, the third signal being integrated either toward or away from a predetermined value, so that any voltage errors generated because the load voltage is interrupted only at a one of the zero crossing points are automatically corrected during subsequent load voltage interruption;

(f) means for comparing said integrated third signal with a predetermined reference signal and generating either an on-state or an off-state signal; the on-state signal being generated while the integrated third signal is being integrated toward the predetermined value and the off-state signal being generated when the integrated third signal is at or is being integrated away from the predetermined value;

(g) control means for receiving the on-state or off-state signals from the comparing means and for concurrently receiving an input signal indicating when the applied alternating load voltage is at a zero crossing point, the control means producing an output signal for interrupting half cycles of the alternating voltage to the load for a fixed number of zero crossings or half cycles and then automatically producing an output signal for re-applying the load voltage in response to receipt of an off-state signal at a zero crossing point; and (h) means for interrupting and re-applying the application of voltage to said load in response to the output signal from the control means.

2. The circuit according to claim 1, wherein said control means is a microprocessor which is adapted to provide the output signal to said interrupting means in response to receipt of the off-state signal and upon receipt of the input signal including the next zero crossing point and then automatically re-applying the load voltage two zero crossings or two half cycles later.

3. The circuit according to claim 1, wherein the control means is a digital-logic, full-cycle loop comprising:

(a) a network having a first resistor coupled on one end to the comparing means for receiving the on-state or off-state signals therefrom and coupled on the other end to a first node, the first node coupling one diode leading to ground and another diode coupling a second node, the second node connecting a supply voltage source through a second resistor;

(b) a buffer for providing an interrupt signal to said means for interrupting the application of the load voltage in response to a high-state signal;

(c) first and second flip-flops, the Q output terminal of the first flip-flop being connected to the S and D input terminals of the second flip-flop, the Q output terminal of the second flip-flop being coupled to the buffer for presenting either high-state or low-state signals thereto;

(d) a first NAND gate for receiving a zero crossing signal at both of its input terminals and the output terminal being connected to the first and second flip-flops for providing clock pulses thereto; and (e) second and third NAND gates being connected in series, the output terminal of the third NAND gate being tied to both input terminals of the second NAND gate, the second NAND gate output terminal being connected to a D input terminal of the first flip-flop and the Q output terminal of the second flip-flop being connected to one of the input terminals of the third NAND gate, the other input terminal of the third NAND gate being coupled to the comparing means via the second node of the network, so that when there is an on-state signal from the comparing means, a low-state signal is provided from the second NAND gate resulting in a low-state signal from the second flip-flop to the buffer at the next zero crossing which then maintains the application of voltage to said load, and when there is an off-state signal from the comparing means, the buffer receives a high-state signal from the second flip-flop which provides the interrupt signal to the interrupting means.

4. The circuit according to claim 1, wherein the control means is a full-cycle, analog circuit which comprises an analog control network having two resistors, a diode and an operational amplifier connected to function in response to an off-state signal from the comparing means to cause the interrupting means to interrupt the application of voltage to said load; and wherein said sampling means is a differential voltage sensor which senses only the positive half-cycle of the applied load voltage waveform.

5. The circuit according to claim 1, wherein the control means is a network for receiving the on-state or off-state signals from the comparing means, the network functions in conjunction with the zero crossing signal to sink the base of a Darlington transistor in order to cause the interrupting means to interrupt the voltage applied across said load;

wherein the predetermined reference signal coupled to said comparing means is a fixed reference voltage provided by separate positive and negative supply voltages across separate resistors to a common node; and wherein said sampling means is a differential voltage sensor which senses both positive and negative half cycles of the applied load voltage waveform and comprises at least three operational amplifiers.

6. The circuit according to claim 1, wherein said means for providing a set point signal further provides a plurality of set point signals, each set point signal representing the source of a different desired control voltage; and wherein said load comprises the fuser of a reproduction machine.

7. A circuit for monitoring and controlling the voltage $V_{on}$ applied to a load from an alternating source without voltage error buildup in the circuit by continually solving and detecting the solution for $N_{on}$ in the equation $K=N_{on}(V^2_{on}-V^2_{rms})$, where $N_{on}$ represents the desired number of on half cycles of the waveform of $V_{on}$ to achieve the desired load voltage $V_{rms}$ and where $K=(V^2_{rms})$, and interrupting the voltage $V_{on}$ for one full cycle or two half cycles each time the desired number of on half cycles of $V_{on}$ has been detected, the circuit comprising:

(a) means for sampling the applied voltage across the load;

(b) means for providing a signal $V^2_{on}$ representing the square of said sampled voltage;

(c) means for providing a set point signal $V^2_{rms}$ representing the square of a desired control voltage;

(d) means for continuously combining said $V^2_{on}$ and $V^2_{rms}$ signals to provide a third signal representing the difference therebetween;

(e) means for continuously integrating said third signal, the integration of the third signal being continuously conducted either toward or away from the predetermined value K rather than being reset to zero when the value K is reached, so that voltage errors encountered are taken into account and self-corrected;

(f) means for comparing said integrated third signal with the predetermined reference K and generating an output signal, the output signal being an on-state signal while the integrated third signal is being integrated in one direction toward the K value and the output signal being an off-state signal when the integrated third signal is being integrated in the opposite direction from K value;

(g) means for providing a zero crossing signal which indicates the zero crossing points of the half cycles of the waveform for $V_{on}$; and (h) means for interrupting the voltage $V_{on}$ applied across the load for one full cycle or two half cycles in response to an off-state signal from the comparing means and indication of the zero crossing point by said zero crossing signal.

8. A method of controlling the voltage applied across the fuser of a reproduction machine from an alternating voltage source without the accumulation of voltage errors comprising the steps of:

(a) sampling the voltage across the fuser;

(b) providing a load square signal representing the square of the sampled voltage;

(c) producing a set point signal representing the square of a desired control voltage;

(d) continuously combining said load square signal and said set point signal to provide a third signal representing the difference therebetween;

(e) continuously integrating said third signal so that the third signal is either being integrated toward or away from a predetermined value and so that the integrating means is not reset to zero when said predetermined value is reached;

(f) comparing said integrated third signal with a predetermined reference signal and generating an on-state signal when said integrated third signal is being integrated toward the value of said predetermined reference signal and generating an off-state signal when said integrated third signal is at or is being integrated away from the value of the predetermined reference signal;

(g) sensing the zero crossing points of the alternating load voltage waveform and producing a zero crossing signal indicative thereof;

(h) monitoring the on-state and off-state signals and the zero crossing signal and producing an interrupt signal in response to an off-state signal and the next zero crossing point; and (i) interrupting the application of voltage to the fuser in response to said interrupt signal for a predetermined number of half cycles of the alternating load voltage and then repeating step h, so that any voltage errors encountered because the load voltage is interrupted only at the zero crossing points are automatically corrected during subsequent load voltage interruption cycles.

* * * * *

UNITED STATES PATENT AND TRADEMARK OFFICE

CERTIFICATE OF CORRECTION

PATENT NO. : 4,435,677

DATED : March 6, 1984

INVENTOR(S) : Dale C. Thomas

It is certified that error appears in the above-identified patent and that said Letters Patent are hereby corrected as shown below:

Claim 2, Column 11, Line 48, substitute the word "including" to - - indicating- -.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*